US005109680A

United States Patent [19]

Pernick

[11] Patent Number: 5,109,680

[45] Date of Patent: May 5, 1992

[54] METHOD AND MACHINE FOR KNITTING JACQUARD PILE FABRIC

[75] Inventor: Bruce M. Pernick, Glendale, N.Y.

[73] Assignee: Monarch Knitting Machinery Corporation, Glendale, N.Y.

[21] Appl. No.: 602,800

[22] Filed: Oct. 24, 1990

[51] Int. Cl.[5] ..... D04B 35/02

[52] U.S. Cl. ..... 66/93; 66/193

[58] Field of Search ..... 66/91, 93, 92, 193, 66/194

[56] References Cited

U.S. PATENT DOCUMENTS

| | | | |
|---|---|---|---|
| 3,241,337 | 3/1966 | Stevens, Jr. | 66/93 |
| 4,409,800 | 10/1983 | Gutschmidt et al. | 66/93 X |
| 4,926,660 | 5/1990 | Takashi | 66/93 X |

FOREIGN PATENT DOCUMENTS

| | | | |
|---|---|---|---|
| 0043135 | 6/1980 | European Pat. Off. | 66/93 |

*Primary Examiner*—Andrew M. Falik
*Assistant Examiner*—John J. Calvert
*Attorney, Agent, or Firm*—Bell, Seltzer, Park & Gibson

[57] ABSTRACT

Two or more pile yarns of different colors selectively form single or multiple wale pile loops in each body or ground yarn course of the fabric. First and second pile yarn loop forming elements, in the form of dial hook elements, are supported in the dial and are selectively moved outwardly to pick up the pile yarns fed thereto at successive yarn feeding stations while the cylinder needles are selectively raised at the successive yarn feeding stations to catch the pile yarn as the dial hook elements are withdrawn inwardly into the dial. The selective outward and inward movement of the first and second dial hook elements makes it possible to send one dial hook element outwardly and bring back a pile yarn to be engaged in the hooks of both the first and second dial hook elements. Ground or body yarn is fed to the needles and the needles form stitch loops to form a course of fabric with the pile loops of the first and second pile yarns incorporated in the stitch loops of the ground yarn. The pile loops are adapted to be cut in a shearing operation to form the patterned velour jacquard fabric.

13 Claims, 4 Drawing Sheets

METHOD AND MACHINE FOR KNITTING JACQUARD PILE FABRIC

FIELD OF THE INVENTION

This invention relates generally to a method and circular knitting machine for knitting jacquard pile fabric and more particularly to such a method and machine in which the jacquard pile fabric includes two or more pile yarns of different colors selectively forming single or multiple wale pile loops incorporated in each body or ground yarn course of the fabric. This type of jacquard pile fabric is formed by providing two dial hook elements in each groove of the dial of the knitting machine. The dial hook elements are selectively moved outwardly to pick up the pile yarns fed thereto at successive pile yarn feeding stations while the cylinder needles are selectively raised at the pile yarn feeding stations to catch the yarn as the dial hook elements are withdrawn inwardly into the dial.

BACKGROUND OF THE INVENTION

In the knitting of circular knit pile fabric, it is the normal practice to knit a single pile yarn and a body or ground yarn together in plated relationship at every knitting station while forming pile or terry loops of the pile yarn. The pile or terry loops are formed by advancing sinkers between adjacent cylinder needles so that the pile or terry loops are formed over the upper nibs of the sinkers while the body yarn stitch loops are drawn over the lower stitch drawing ledge of the sinkers. After the terry loops are formed in this manner, the fabric is sheared to produce pile extending outwardly from one surface of the knit fabric. However, the length of the pile or terry loops formed in this manner is limited by the height of the upper nib of the sinkers. This knit fabric is rather heavy and bulky since the pile yarn is knit in plated relationship with the body of ground yarn in the needle loops and it is not possible to easily change the height of the pile or terry loops being formed. Also, the plating of the pile yarn with the body yarn may not be accurately controlled so that portions of the pile yarn may be visible and may extend inwardly on the inside or back of the fabric.

Recognizing these deficiencies of pile fabric formed with the use of sinkers, the Mishcon U.S. Pat. No. 2,796,751 discloses the formation of a circular knit pile fabric by employing hooked loop jacks in the dial of the circular knitting machine so that the height of the pile or terry loops can be varied by merely varying the amount the hooked loop jacks are withdrawn or retracted into the dial, after picking up the pile yarn therein. This patent also discloses eliminating the problem of plating of the pile yarn with the body yarn by inlaying the pile yarn in the knit fabric formed by the body yarn. However, this patent discloses utilizing half the number of hooked loop jacks as the number of cylinder needles and forming plain jersey stitch loops of body yarn on alternate cylinder needles while forming the pile or terry loops of the pile yarn on every hooked loop jack at each knitting station. The pile fabric produced in accordance with this patent thus includes a pile or terry loop extending inwardly and between every wale of the plain jersey stitch loops of each course of the body yarn.

U.S. Pat. No. 5,016,450, dated May 21, 1991, a circular knit pile fabric and method is disclosed in which the successive courses of body yarn include pile yarn inlaid in every other wale while pile or terry loops extend inwardly and across the remaining wales, and wherein the pile or terry loops in alternating single courses are staggered walewise relative to the pile or terry loops in intervening single courses. The disclosed method of knitting the circular knit pile fabric of my copending application is carried out on a circular knitting machine including a plurality of circularly arranged cylinder needles movable vertically between latch clearing and stitch drawing positions. A single dial hook element is supported in each groove of the dial and the number of dial hook elements is equal to the number of cylinder needles.

The pile fabric produced in accordance with my copending application does permit the pile loops of the pile fabric to be formed of any desired length and the length of the pile loops is not determined by the height of the various ledges of the sinkers. However, the pile fabric produced in accordance with my copending application is limited to a single color of pile yarn in each course of the body or ground yarn.

SUMMARY OF THE INVENTION

With the foregoing in mind, it is an object of the present invention to provide a method and circular knitting machine for knitting a pile jacquard fabric with two or more pile yarns of different colors selectively forming single or multiple wale pile loops incorporated in each body or ground course, and wherein the circular knitting machine includes needles supported for vertical movement in a needle cylinder, first and second dial hook elements supported in each groove of a dial for horizontal movement in a radial direction and between selected cylinder needles, and a plurality of groups of spaced-apart yarn feeding stations.

The pile jacquard fabric knit in accordance with the method and machine of the present invention includes successive courses of wales of stitch loops knit of ground or body yarn. Each successive ground yarn course includes a first pile loop yarn inlaid with the ground yarn in selected needle wales and forming a pile loop therebetween. A second pile loop yarn is inlaid with the ground yarn in other needle wales and forming a pile loop therebetween. Floats of the first pile loop yarn extend above the pile loops in the corresponding selected needle wales, and floats of the second pile loop yarn extend above the pile loops in the corresponding other needle wales. The upstanding pile loops and floats are adapted to be cut in a shearing operation to form a patterned velour jacquard fabric. Additional pile yarns can also be incorporated with the ground yarn in each course of the pile jacquard fabric.

In accordance with the present invention, at least two dial hook elements are provided between cylinder needles which operate to draw yarn and form wale pile loops or floats around selected cylinder needles. The option is provided of transferring the pile loops and floats formed on the dial hook elements at one pile loop yarn feed station to other dial hook elements at a successive pile loop yarn feed station. After ground yarn is fed to the cylinder needles and the fabric is formed, the pile loops and floats are released by the outward movement of the dial hook elements.

The present method of knitting a pile jacquard fabric is carried out on a circular knitting machine including needles supported for longitudinal movement to form stitch loops of ground yarn fed thereto, first and second pile yarn loop forming elements supported between each of the needles for longitudinal movement at substantially right angles to the longitudinal movement of the needles, and a plurality of groups of successive spaced-apart yarn feeding stations. The longitudinal movement of the pile yarn loop forming elements and the needles cross each other along a crossing or verge line.

In its broadest aspect, the present method includes the sequential steps of moving selected of the pile yarn loop forming elements beyond the crossing line and feeding a first pile yarn thereto, moving selected needles beyond the crossing line, and then moving at least certain of the selected pile yarn loop forming elements inside of the crossing line at a first yarn feeding station to draw loops of the first pile yarn between the selected needles. A second pile loop yarn is fed to selected pile yarn loop forming elements at a second yarn feeding station, selected needles are moved beyond the crossing line, and selected pile yarn loop forming elements are moved inside of the crossing line to draw loops of the second pile yarn between the selected needles. Selected of the needles are then moved beyond the crossing line to a clearing level and the ground yarn is fed thereto, and then selected needles are moved inside of the crossing line and to a knitting level to form a course of ground yarn stitch loops with the first and second pile loop yarns incorporated with the ground yarn in selected needle wales.

More specifically, one embodiment of the method includes the sequential steps of moving each of the first dial hook elements outwardly at the first yarn feeding station and feeding the first pile yarn thereto while raising selected needles above the level of the dial hook elements. The first dial hook elements are then withdrawn at the first yarn feeding station to draw an inward loop of the first pile yarn. As the first dial hook elements are withdrawn, the loops formed by their hooks may be transferred into the hooks of the second dial hook elements so that the drawn loops are engaged by the hooks of both the first and second dial hook elements. Each of the second dial hook elements is moved outwardly at the second pile yarn feeding station and the second pile yarn is fed thereto while other selected needles are raised above the level of the dial hook elements and the second dial hook elements are withdrawn to draw an inward loop of the second pile yarn. All of the cylinder needles are raised to a clearing level at the third yarn feeding station and the ground yarn is fed thereto. All of the needles are then lowered to knitting level at the third yarn feeding station to form a course of plain jersey stitches of the ground yarn with individual pile loops of the first pile yarn extending upwardly from between the corresponding selected needle wales and with individual pile loops of the second pile yarn extending upwardly from between the corresponding other needle wales. Floats of the first pile yarn extend above the pile loops of the second pile yarn and floats of the second pile yarn extend above the pile loops of the first pile yarn.

In other disclosed embodiments, both the first and second dial hook elements are moved outwardly to pick up the first pile yarn at the first pile yarn feeding station while only the first dial hook elements are moved outwardly to pick up the second pile yarn at the second pile yarn feeding station (FIG. 10). In another embodiment (FIG. 11), both the first and second dial hook elements are moved outwardly to pick up the first pile yarn at the first pile yarn feeding station while only the second dial hook elements are drawn inwardly and the first dial hook elements are not drawn inwardly until they pass the second pile yarn feeding station. In a further embodiment (FIG. 12), only the first dial hook elements are moved outwardly and inwardly at both the first and second pile yarn feeding stations while the second dial hook elements remain in an inward position as they pass both pile yarn feeding stations. Additionally, third and fourth pile yarn feeding stations are provided (FIGS. 15 and 16) so that jacquard knit fabrics can be formed with more than two colors of pile yarn incorporated in each course. Thus, the outward and inward movements of the first and second dial hook elements can be selectively varied at each of the pile yarn feeding stations.

The first and second dial hook elements have downwardly and inwardly extending hooks on their outer ends which extend below the level of the lower sliding edge of the dial hook elements. These downwardly extending hooks each have an inwardly inclined outer cam surface which operates to cause the outwardly moving second dial hooks to cam the pile yarn caught by the inwardly moving first dial hooks down below the outwardly moving second dial hooks. At this time, the inwardly moving first dial hooks hold the pile yarn loops and floats which were picked up by the first dial hooks at a previous pile yarn feed.

The provision of the pairs of dial hook elements in each slot or groove of the dial, and the selective raising of the cylinder needles at successive pile yarn feeding stations permits a wide variety of different colors of pile yarns to be incorporated in the knit fabric. The selective formation of individual pile loops and multi-wale floats of each of the pile yarns in a single body or ground course permits the knitting of a wide variety of different types of patterned velour jacquard fabrics.

BRIEF DESCRIPTION OF THE DRAWINGS

Other objects and advantages will appear as the description proceeds when taken in connection with the accompanying drawings, in which --

DESCRIPTION OF THE PREFERRED EMBODIMENT

Figure 13:
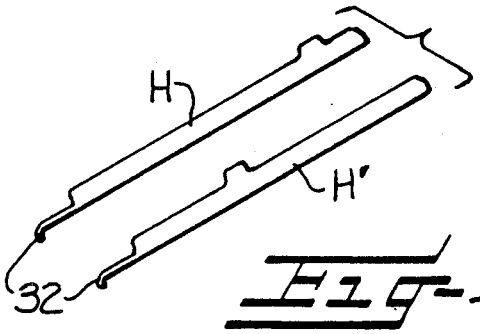
FIG. 13 is an isometric view of the first and second dial hook elements supported for radial sliding movement in each groove of the dial.

The circular knitting machine employed in the practice of the present invention includes latch needles N supported for vertical movement in the grooves of a needle cylinder 10 (FIGS. 2-6). Respective first and second pile yarn loop forming elements, shown as respective dial hook elements H, H' (FIG. 13), are supported in each radial slot or groove of a dial 11 (FIGS. 2-6) for horizontal movement in a radial direction and between adjacent cylinder needles N. Longitudinal movement of the dial hook elements H, H' is at substantially right angles to the longitudinal movement of the needles N and they are adapted to at times cross each other along a crossing or verge line.

Figure 1:
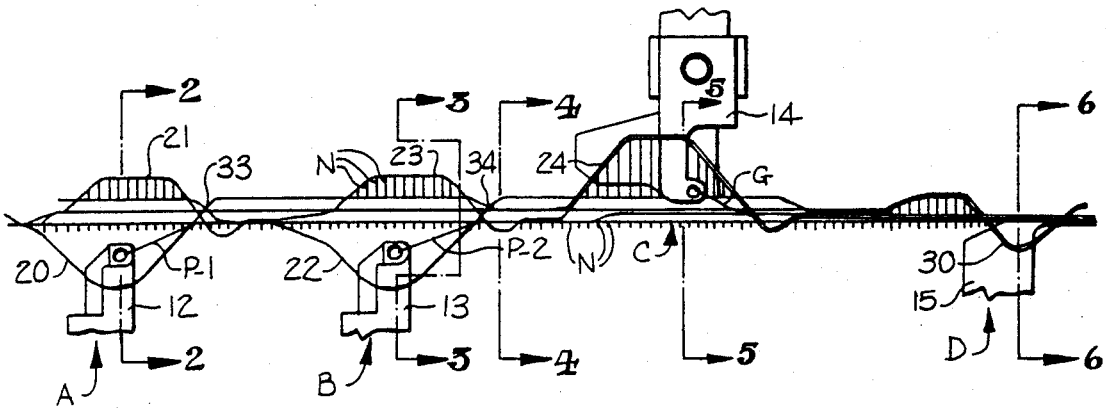
FIG. 1 is a somewhat schematic illustration of one manner in which the cylinder needles and the dial hook elements form the pile jacquard fabric at three successive yarn feeding stations.

As illustrated in FIG. 1, a plurality of groups of four successive spaced-apart stations, indicated broadly at A-D are positioned around the needle cylinder 10. The first two successive spaced-apart stations A, B will be referred to as pile yarn feeding stations, the station C will be referred to as a body or ground yarn feeding and knitting station, and the fourth station D will be referred to as a pile loop and fabric shedding or hold-down station. A first pile yarn feed finger 12 is positioned at the first yarn feeding station A for feeding a first pile yarn P-1 to the dial hook elements and to the needles. A second pile yarn feeding finger 13 is positioned at the second yarn feeding station B for feeding a second pile yarn P-2 to the dial hook elements and the needles. A body or ground yarn feeding finger 14 is positioned at the third yarn feeding station C for feeding a body or ground yarn G to the cylinder needles N. A fabric and loop hold-down plate 15 is supported at the fourth station D and includes a horizontal inwardly extending portion 16 (FIG. 6) which overlies the upper end of the needle cylinder 10 and is used to hold the fabric down and to positively insure that the pile loops are removed from the dial hook elements H, H' and maintained in an innermost position inwardly of the described.

Figure 2:
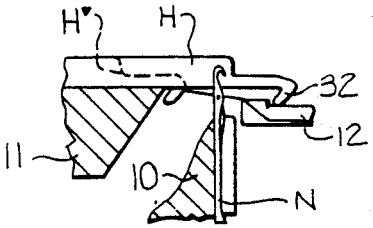
FIGS. 2-6 are fragmentary vertical sectional views taken along the respective section lines 2—2 through 6—6 in FIG. 1, illustrating the relative positions of the needles and the dial hook elements at the indicated locations.
Figure 3:
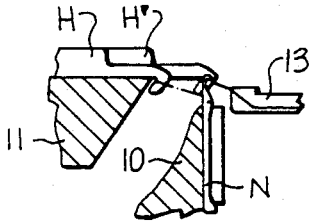
Figure 4:
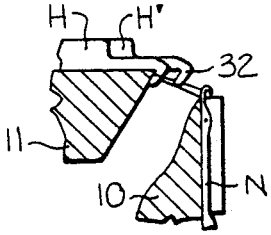
Figure 5:
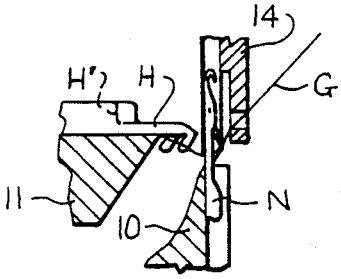
Figure 7:
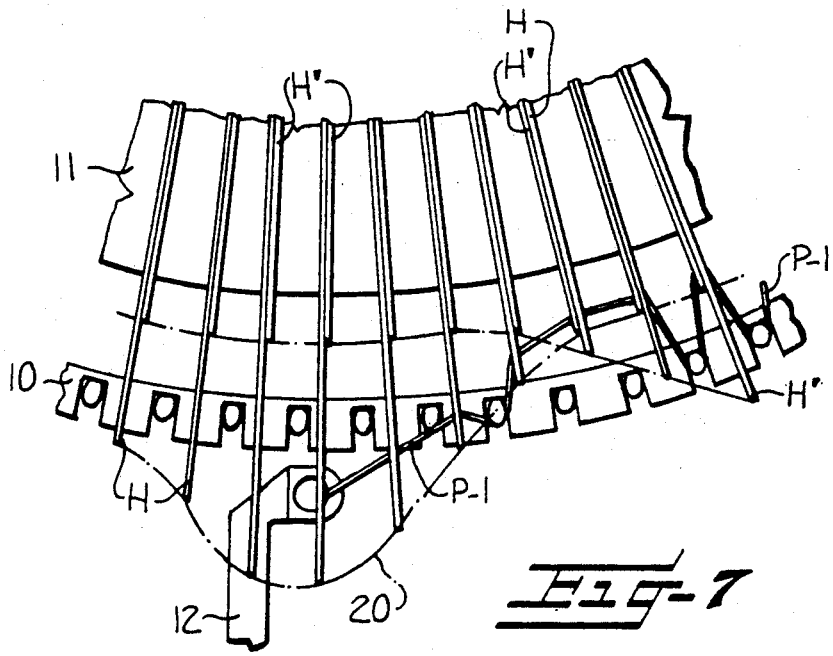
FIG. 7 is a fragmentary plan view illustrating the manner in which the first dial hook elements are extended outwardly to pick up the first pile yarn at the first pile yarn feeding station.

The knitting of a very simple vertically striped jacquard pile fabric, of the type illustrated in FIG. 14, will be described. However, it is to be understood that other more complicated jacquard pile fabrics can be knit in accordance with the present invention. Referring to FIG. 1, the first dial hook elements H are moved outwardly beyond the crossing line with the cylinder needles N as they pass the first pile yarn feeding station A while the second dial hook elements H' remain in a withdrawn position in the dial 11, as illustrated in FIGS. 2 and 7. The first dial hook elements H are moved outwardly and then inwardly and inside of the crossing line with the cylinder needles N along the path of travel indicated at 20 in FIGS. 1 and 7 and above the level of the first pile yarn feed finger 12. Selected needles N are raised and moved beyond the crossing line with and above the level of the hooks of the first dial hook elements H at the first yarn feed station A and are then lowered as they pass along a pathway indicated at 21. As the first dial hook elements H are withdrawn, the first pile yarn P-1 is caught by the downwardly extending hooks to draw a single pile yarn loop between raised needles while drawing a multi-wale float of the pile yarn P-1 over those cylinder needles N which were not raised at the first yarn feeding station, as illustrated in FIG. 7.

As will be noted in FIGS. 2-6 and 13, the dial hook elements H, H' have downwardly extending hooks on their outer ends which extend below the level of the lower sliding edges of the dial hook elements. These downwardly extending hooks each have an inwardly inclined outer cam surface 32 which cam the pile yarn downwardly, in a manner to be described, so that the pile yarn is at times transferred from the hook of one dial hook element to the hooks of another or both dial hook elements.

As illustrated in the right-hand portion of FIG. 7, the first pile yarn P-1 is drawn inside of selected needles N by the first dial hook elements H while the second dial hook elements H' begin their outward movement. As these second dial hook elements H' move outwardly, the inclined outer cam surface 32 engages and pushes the pile yarn P-1 downwardly so that the hook of the second dial hook element H' rides over the pile yarn P-1. Thus, the pile yarn P-1 is also positioned inside of the hook of the second dial hook element H' as the second dial hook element H' is moved outwardly at the right-hand portion of FIG. 7.

Figure 8:
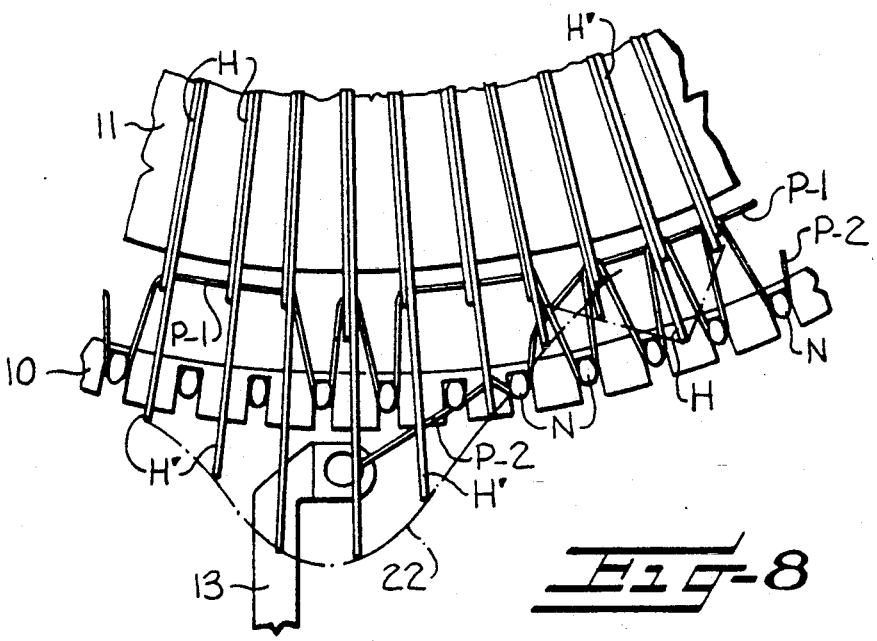
FIG. 8 is a view similar to FIG. 7 but illustrating the manner in which the second dial hook elements are extended outwardly and pick up the second pile yarn at the second pile yarn feeding station.

The second dial hook elements H' are moved outwardly beyond the crossing line with the cylinder needles N at the second pile yarn feeding station B and are then drawn inwardly inside of the crossing line with the cylinder needles N, as indicated by the travel path 22 in FIGS. 1 and 8, to pick up the second pile yarn P-2 from the second pile yarn feed finger 13. At this second yarn feeding station B, other pairs of adjacent needles N are raised and moved beyond the crossing line with and above the level of the hooks of the second dial hook elements H' and are then lowered, along a path of travel indicated at 23. As the second dial hook elements H' are withdrawn at the second yarn feeding station, an inward pile loop of the second yarn P-2 is drawn between the adjacent needles which have been raised at the second yarn feeding station and a multi-wale float of the yarn P-2 is formed above the needles which were not raised at this second pile yarn feeding station B.

As illustrated in the right-hand portion of FIG. 8, the second pile yarn P-2 is drawn inside of selected needles N by the second dial hook elements H' while the first dial hook elements H remain inwardly and hold the loops and floats of the pile yarn P-1. The second dial hook elements H' are drawn inwardly while the first dial hook elements H are moved outwardly and inwardly so that both the first and second pile yarns P-1, P-2 are held in the hooks of the first and second dial hook elements H, H'. Thus, the first and second pile yarns P-1 and P-2 are held in the hooks of both the first and second dial hook elements H, H', as indicated in the right-hand portion of FIG. 8.

Figure 14:
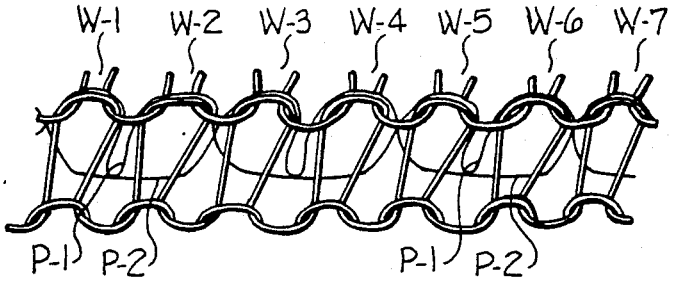
FIG. 14 is a greatly enlarged fragmentary isometric view of one course of one illustrative type of pile jacquard fabric produced in accordance with the present invention.

At the third body or ground yarn feeding and knitting station C, all of the dial hook elements H and H' are maintained in a withdrawn position while all of the cylinder needles N are raised to a clearing level along a pathway 24 (FIG. 1) and then lowered while the body or ground yarn G is fed thereto to form plain as indicated in FIG. 14. As indicated in FIG. 14, the first pile yarn P-1 forms individual pile loops between the needle wales W-6, W-5 and W-2, W-1 and forms a multi-wale float across the needle wales W-3, W-4. The second pile yarn P-2 forms an individual pile loop between the needle wales W-4 and W-3 and forms multi-wale floats across the needle wales W-6, W-5 and W-1, W-2.

Figure 6:
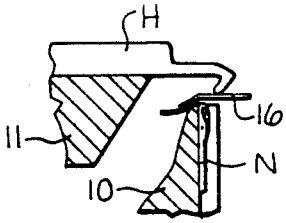

If desired, it is possible to hold the fabric down and to strip the pile loops and multi-wale floats from the dial hook elements H, H' after the cylinder needles N have been lowered to knitting position at the third body yarn feeding and knitting station C. However, it is possible to positively strip the pile loops from the dial hook elements H, H' and to maintain the pile loops inside of the needles N (FIG. 6). To this end, the cylinder needles N are again lowered at the fourth station D (FIGS. 1 and 6) while the dial hook elements H, H' are moved outwardly along a path of travel indicated at 30 in FIG. 1. Thus, the loops of the pile yarns P-1 and P-2 are positively stripped from the hooks of the dial hook elements H, H', and the fabric is held down by the plate 16 (FIG. 6) when the needles N are again raised.

As shown in FIG. 1, the first dial hook elements H are drawn inwardly after they pass the station A, as indicated by the path of travel 20, while the second dial hook elements H' are moving outwardly with their paths of travel crossing, as indicated at 33 in FIG. 1. When this occurs, the first pile yarn P-1, being drawn inwardly by the dial hook element H, is engaged by the cam surface 32 on the adjacent dial hook element H' and is lowered by the cam surface 32 so that the pile yarn loop passes inside of the hooks of both of the dial hook elements H, H'. Following the pile yarn feeding station B, the same action takes place as the dial hook elements H' are moving inwardly, as indicated by the path of travel 22, and the dial hook elements H are moving outwardly, with their paths of travel crossing, as indicated at 34 in FIG. 1.

Figure 15:
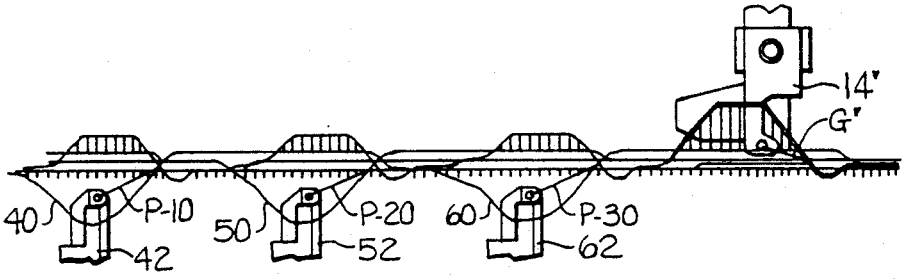
FIG. 15 is a view similar to FIG. 1 but showing three pile yarn feeding stations.
Figure 16:
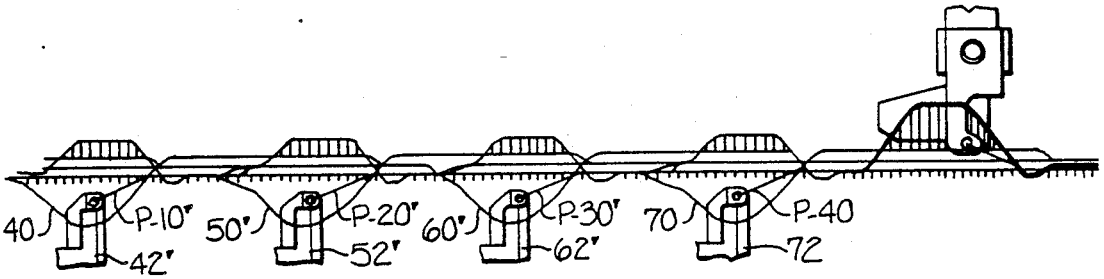
FIG. 16 is a view similar to FIG. 15 but showing four pile yarn feeding stations.

While two different colors of pile yarns P-1 and P-2 are described as being fed to the dial hook elements at the first two yarn feeding stations A and B, to form a rather simple jacquard pile fabric, it is to be understood that additional colors of pile yarns could be fed to the dial hook elements at additional yarn feeding stations while the needles are selectively raised to form additional individual pile loops and multi-wale floats in the jacquard knit fabric. The feeding of additional pile yarns at additional pile yarn feeding stations is illustrated in FIGS. 15 and 16, to be presently described. Since the pile yarns may be inlaid in the courses of the body yarn, each course of the jacquard fabric is of a lighter weight construction than a similar type of fabric in which the pile yarns are knit in plated relationship with the body yarn in each course. However, it is to be understood that the pile yarns can be knit in plated relationship with the body or ground yarn. Also, the inlaying of the pile yarns with the body yarn in each course of the fabric eliminates the plating problem which can occur in this type of fabric when the pile yarns are knit in plated relationship with the body yarn.

Figure 9:
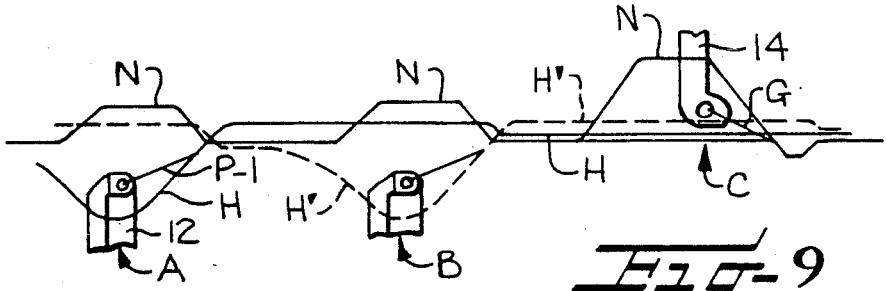
FIGS. 9-12 illustrate different selected movements of the dial hook elements at the successive yarn feeding stations.
Figure 10:
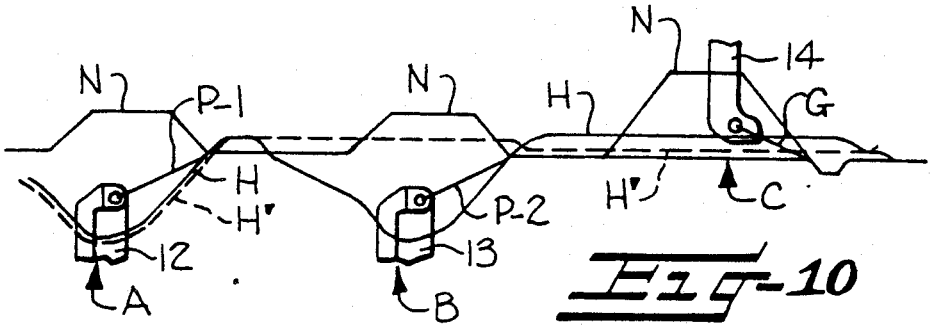
Figure 11:
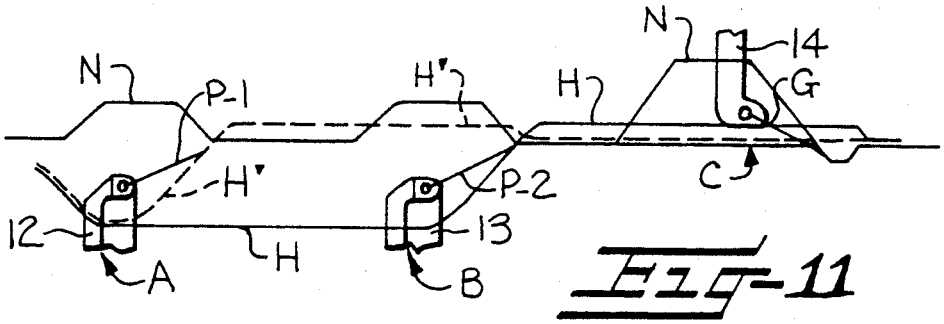
Figure 12:
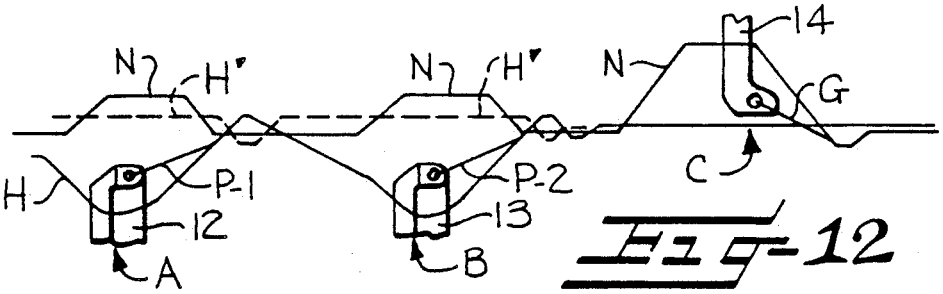

FIGS. 9-12 illustrate some of the various types of selected movements which may be imparted to the first and second dial hook elements H, H' at the successive pile yarn feeding stations A and B. In FIG. 9, only the first dial hook elements H are moved outwardly and then inwardly at the first pile yarn feeding station A while only the second dial hook elements H' are moved outwardly and then inwardly at the second pile yarn feeding station B. This embodiment corresponds with the selected movement described above in connection with FIGS. 1, 7 and 8. In FIG. 10, both the first and second dial hook elements H, H' are moved outwardly and then inwardly at the first pile yarn feeding station A while only the first dial hook elements H are moved outwardly and then inwardly at the second pile yarn feeding station B. In FIG. 11, both the first and second dial hook elements H, H' are moved outwardly at the first pile yarn feeding station A while only the second dial hook elements H' are withdrawn at the first pile yarn feeding station A. The first dial hook elements H remain in the outer position until they pass the second pile yarn feeding station B, where they are drawn inwardly. In FIG. 12, the first dial hook elements H are moved outwardly and then inwardly at both the first and second pile yarn feeding stations A and B while the second dial hook elements H' remain in an inward position at both the first and second pile yarn feeding stations A and B.

FIGS. 15 and 16 illustrate the manner in which more than two colors of pile yarns can be incorporated in the fabric in accordance with the present invention. The formation of a three-color fabric is shown in FIG. 15 where selected dial hook elements are moved outwardly and then inwardly along a path of travel 40 at a first pile yarn feeding station to pick up a first pile yarn P-10 being fed by a first pile yarn feeding finger 42. Selected dial hook elements are moved outwardly and then inwardly along a path of travel 50 at a second pile yarn feeding station to pick up a second pile yarn P-20 being fed by a second pile yarn feeding finger 52. Selected dial hook elements are moved outwardly and then inwardly along a path of travel 60 at a third pile yarn feeding station to pick up a third pile yarn P-30 being fed by a third pile yarn feeding finger 62. These three pile yarns are then incorporated in the single course of fabric as body or ground yarn G' is fed to the needles by a ground yarn feed finger 14'.

The formation of a four-color fabric is shown in FIG. 16 where the action described in connection with FIG. 15 is repeated at the first three pile yarn feeding stations, with the prime notation being added to the corresponding reference characters. Selected dial hook elements are moved outwardly and then inwardly along a path of travel 70 at a fourth pile yarn feeding station to pick up a fourth pile yarn P-40 being fed by a fourth pile yarn feeding finger 72. Then all four pile yarns are incorporated in the single course of fabric as the ground yarn G' is fed to the needles by the ground yarn feed finger 14'.

In each of the described embodiments the jacquard pile fabric can be knit with a single body or ground yarn forming plain jersey stitch loops in each course, and with the pile yarns being either inlaid or knit in plated relationship with the ground yarn. However, it is to be understood that two or more body or ground yarns can be selectively fed to the needles to form other than plain jersey types of stitch loops, such as knit/welt or knit/-tuck stitch loops in each course.

While needles with pivoted latches are illustrated as being used as the cylinder needles N, it is to be understood that compound sliding latch type needles may be used. Also, needles with latches or compound needles may be used in place of the illustrated dial hook elements H, H' and the illustrated positions of the needles and dial hook elements may be reversed. The first and second dial hook elements H, H' are illustrated as being positioned in the same groove of the dial 11 but could each be supported in closely spaced adjacent grooves.

In the drawings and specification there has been set forth the best mode presently contemplated for the practice of the present invention, and although specific terms are employed, they are used in a generic and descriptive sense only and not for purposes of limitation, the scope of the invention being defined in the claims.

What is claimed is:

1. A method of knitting a pile jacquard fabric on a circular knitting machine including needles supported for longitudinal movement to form stitch loops of ground yarn fed thereto, first and second pile yarn loop forming elements supported between adjacent of said needles for longitudinal movement at substantially right angles of a longitudinal movement of said needles, the longitudinal movement of said pile yarn loop forming elements and of said needles crossing each other along a verge line defined by the verge of the needle cylinder, and a plurality of groups of successive spaced-apart pile yarn feeding stations, said pile jacquard fabric including successive courses of stitch wales knot of ground yarn, and each successive course also including pile loop yarn incorporated with the ground yarn in selected needle wales, said method including the steps of moving selected of said first and second pile yarn loop forming elements beyond said verge line at successive of said yarn feeding stations and feeding pile yarn thereto, moving selected needles beyond said verge line at successive of said yarn feeding stations, moving said selected pile yarn loop forming elements inside of said verge line at successive of said yarn feeding stations to draw loops of the pile yarn between the selected needles and transferring previously drawn loops and floats thereby capturing and controlling the drawn pile yarn loops and floats, while allowing the other of said first and second pile yarn loop forming elements to be free to permit the same to capture another pile yarn at the next yarn feeding station, and forming a course of ground yarn stitch loops with the first and second pile loop yarns incorporated with the ground yarn in selected needle wales.

2. A method of knitting a pile jacquard fabric on a circular knitting machine including needles supported for longitudinal movement to form stitch loops of ground yarn fed thereto, first and second pile yarn loop forming elements supported between each of said needles for longitudinal movement at substantially right angles to the longitudinal movement of said needles, the longitudinal movement of said pile yarn loop forming elements and said needles being adapted to cross each other along a crossing line, and a plurality of groups of successive spaced-apart yarn feeding stations, said pile jacquard fabric including successive courses of stitch wales knit of ground yarn, and each successive course also including pile loop yarn incorporated with the ground yarn in selected needle wales, said method including the steps of moving selected of said first and second pile yarn loop forming elements beyond said crossing line at one of said yarn feeding stations and feeding pile yarn thereto, moving selected needles beyond said crossing line at said one yarn feeding station, and moving said selected pile yarn loop forming elements inside of said crossing line at said one yarn feeding station to draw loops of the pile yarn between the selected needles and to cause the drawn pile yarn loops to be engaged by both of said first and second pile yarn loop forming elements.

3. A method of knitting a pile jacquard fabric on a circular knitting machine including needles supported for longitudinal movement to form stitch loops of ground yarn fed thereto, first and second pile yarn loop forming elements supported between adjacent of said needles for longitudinal movement at substantially right angles to the longitudinal movement of said needles, the loop forming elements each having downwardly extending hooks and inwardly and downwardly inclined outer cam surfaces on the outer portion of the downwardly extending hooks, the longitudinal movement of said pile yarn loop forming elements and said needles crossing each other along a verge line defined by the verge of the needle cylinder, and a plurality of groups of successive spaced-apart pile yarn feeding stations, said pile jacquard fabric including successive courses of stitch wales knit of ground yarn, and each successive course also including pile loop yarn incorporated with the ground yarn in selected needle wales, said method including the steps of moving selected of said pile yarn loop forming elements beyond said verge at a first yarn feeding station and feeding the first pile yarn thereto, moving selected needles beyond said verge line at said first yarn feeding station, moving at least certain of said selected pile yarn loop forming elements inside of said verge line at said first yarn feeding station to draw loops of the first pile yarn between the selected needles, feeding the second pile loop yarn to selected pile yarn loop forming elements at a second yarn feeding station, and while passing the inclined outer cam surface of those yarn loop forming elements moving outward to receive the pile yarn at the second yarn feeder over the first yarn drawn in by the first pile yarn loop forming elements, moving selected needles beyond said verge line at said second yarn feeding station, moving said selected pile yarn loop forming elements inside of said verge line at said second yarn feeding station to draw loops of the second pile yarn between the selected needles, moving selected of said needles beyond said verge line to a clearing level and feeding the ground yarn thereto, and, moving said selected needles inside of said verge line and to a knitting level to form a course of ground yarn stitch loops with said first and second pile loop yarns incorporated with the ground yarn in selected needle wales.

4. A method of knitting according to claim 3 wherein said first pile yarn loop forming elements are moved beyond and then inside of said crossing line at said first yarn feeding station, and said second pile yarn loop forming elements are moved beyond and then inside of said crossing line at said second yarn feeding station.

5. A method of knitting according to claim 3 wherein said first and second pile yarn loop forming elements are moved beyond said crossing line at said first yarn feeding station, said first and second pile yarn loop forming elements are moved inside of said crossing line at said first yarn feeding station, and said second pile yarn loop forming elements are moved beyond and then inside of said crossing line at said second yarn feeding station.

6. A method of knitting according to claim 3 wherein said first and second pile yarn loop forming elements are moved beyond said crossing line at said first yarn feeding station, said first pile yarn loop forming elements are moved inside of said crossing line at said first yarn feeding stations while said second pile yarn loop forming elements remain beyond said crossing line at said first yarn feeding station, and said second pile yarn loop forming elements are moved inside of said crossing line at said second yarn feeding station.

7. A method of knitting according to claim 3 wherein all of said needles are moved to clearing level and form stitch loops of ground yarn at a third yarn feeding station.

8. A method of knitting according to claim 7 including the step of shedding the pile loop fabric at a fourth station.

9. A method of knitting a pile jacquard fabric on a circular knitting machine including needles supported for vertical movement in a needle cylinder, first and second dial hook elements supported in grooves of a dial for horizontal movement in a radial direction and between adjacent cylinder needles, and a plurality of groups of three successive spaced-apart yarn feeding stations, said pile jacquard fabric including successive courses of stitch wales knit of a ground yarn, each successive course also including a first pile loop yarn inlaid with the ground yarn in selected needle wales and forming an individual pile loop therebetween, a second pile loop yarn inlaid with the ground yarn in other needle wales and forming an individual pile loop therebetween, multi-wale floats of the first pile loop yarn extending above the individual pile loops of the corresponding selected adjacent needle wales, and multi-wale floats of the second pile loop yarn extending above the individual pile loops of the corresponding other adjacent needle wales, and wherein the upstanding individual pile loops and the multi-wale floats are adapted to be cut in a shearing operation to form a patterned velour jacquard fabric, said method including the sequential steps of moving each of said first dial hook elements outwardly at a first yarn feeding station and feeding the first pile yarn thereto, raising selected needles above the level of the dial hook elements at said first yarn feeding station, withdrawing said first dial hook elements at said first yarn feeding station to draw an inward loop of the first pile yarn, moving each of said second dial hook elements outwardly at a second yarn feeding station and feeding the second pile loop yarn thereto, raising other needles above the level of the dial hook elements at said second yarn feeding station, withdrawing said second dial hook elements at said second yarn feeding station to draw an inward loop of the second pile yarn, raising all of said needles to a clearing level at a successive yarn feeding station and feeding the ground yarn thereto, and lowering all of the needles to knitting level at said successive yarn feeding station to form a course of stitch loops with individual pile loops of the first pile yarn extending upwardly from between the corresponding selected pairs of adjacent needle wales, with individual pile loops of the second pile yarn extending upwardly from between the corresponding other pairs of adjacent needle wales, with floats of the first pile yarn extending above the pile loops of the second pile yarn, and with floats of the second pile yarn extending above the pile loops of the first pile yarn.

10. A method of knitting according to claim 9 wherein said first and second dial hook elements are supported in the same groove of said dial.

11. A circular knitting machine for knitting a pile jacquard fabric and including needles supported for vertical movement in a needle cylinder, a plurality of groups of spaced-apart yarn feeding stations surrounding said needle cylinder, a dial supported for rotation with the needle cylinder and including radially extending grooves aligned between adjacent cylinder needles, said knitting machine including first and second dial hook means supported in said grooves of said dial and being positioned in parallel, side-by-side relation to each other for horizontal movement in a radial direction between adjacent cylinder needles for inward and outward movement, said dial hook means including downwardly extending hook means for passing over the yarn drawn in by the other pile loop forming means so that loops of the pile yarn may be drawn by selected pile yarn loop forming elements and so that previously drawn loops and floats may be transferred thereby capturing and controlling the drawn pile yarn loops and floats, while allowing the other of said first and second pile yarn loop forming elements to be free to permit the same to capture another pile yarn at the next feeding station.

12. A circular knitting machine according to claim 11 wherein said first and second dial hook means are supported in the same groove of said dial.

13. A circular knitting machine according to claim 11 wherein said first and second dial hook means each include lower sliding edges supported in the bottom of said radially extending grooves of said dial, a downwardly extending hook extending below said lower sliding edge, and an inwardly and outwardly inclined outer cam surface on the outer portion of said downwardly extending hook.

* * * * *

UNITED STATES PATENT AND TRADEMARK OFFICE

CERTIFICATE OF CORRECTION

PATENT NO. : 5,109,680

DATED : May 5, 1992

INVENTOR(S) : Pernick

It is certified that error appears in the above-identified patent and that said Letters Patent is hereby corrected as shown below:

Column 1, line 66, delete "U.S. Pat." and substitute --In U.S. Pat.-- therefore.

Column 5, line 45, insert before "described" the phrase --needle cylinder 10, in a manner to be presently--.

Column 6, line 63, insert after "plain" and before "as" the phrase -- stitch loops of the ground yarn G in all needle wales,--.

Column 9, line 17, delete "knot" and substitute --knit-- therefore.

Column 10, line 12, insert after "and" and before "said" the word --of--.

Column 12, line 50, delete "outwardly" and substitute --downwardly-- therefore.

Signed and Sealed this

Twenty-fourth Day of August, 1993

Bruce Lehman

*Attest:*

BRUCE LEHMAN

*Attesting Officer*

*Commissioner of Patents and Trademarks*